US006338553B1

(12) United States Patent
Lewis et al.

(10) Patent No.: US 6,338,553 B1
(45) Date of Patent: Jan. 15, 2002

(54) INK SUPPLY TUBE GUIDING SYSTEM FOR LARGE FORMAT PRINTER

(75) Inventors: Richard Lewis; Curt Torgersson; Antoni Monclús; Jesús Garcia; Martin Urrutia, all of Barcelona (ES)

(73) Assignee: Hewlett-Packard Company Intellectual Property Administration, Fort Collins, CO (US)

( * ) Notice: Subject to any disclaimer, the term of this patent is extended or adjusted under 35 U.S.C. 154(b) by 0 days.

(21) Appl. No.: 09/571,038

(22) Filed: May 15, 2000

(51) Int. Cl.[7] ..... B41J 2/175
(52) U.S. Cl. ..... 347/85
(58) Field of Search ..... 347/84, 85, 86, 347/87

(56) References Cited

U.S. PATENT DOCUMENTS

| | | | | |
|---|---|---|---|---|
| 3,102,770 A | * | 9/1963 | McKeegan | 346/140.1 |
| 4,831,389 A | | 5/1989 | Chan | 347/85 |
| 5,369,429 A | | 11/1994 | Erickson | 347/7 |
| 5,469,201 A | | 11/1995 | Erickson et al. | 347/85 |
| 5,489,931 A | | 2/1996 | Shibata et al. | 347/85 |
| 5,686,947 A | | 11/1997 | Murray et al. | 347/85 |
| 6,003,981 A | | 12/1999 | Cameron et al. | 347/85 |
| 6,007,190 A | * | 12/1999 | Murray et al. | 347/86 |

FOREIGN PATENT DOCUMENTS

EP 0826504 A2 3/1998

* cited by examiner

*Primary Examiner*—Anh T. N. Vo
(74) *Attorney, Agent, or Firm*—Roth & Goldman

(57) ABSTRACT

A unitary ink supply tube guiding system for a large format inkjet printer includes a tube guide having a bottom comprising a tube support surface, and generally upwardly, preferably vertically, extending front and rear walls and an anti-buckling wall for confining movement of the ink tubes to prevent tube buckling. The ink tubes are supported throughout a full length to convey ink from stationary reservoirs to printheads mounted on a transversely movable printhead carriage. The tubes are preferably bundled together in at least one vertically extending plane and extend through front and rear substantially parallel reaches joined by a bend. The ink tubes are bundled together along a portion of their length by a protective sheath having wear resistant outer ribs which contact the tube guide. Anti-buckling stretch resistant tension ribs are preferably located along one side of the protective carrier or sheath. The tubes may be arranged if desired in separate protective carriers in parallel vertically extending planes so that the tube carriers do not rub together. An in-line tubes driver is aligned with the tubes in the unitary guide and has a rigid arm for bundling and guiding the tubes from spaced parallel planes into a common horizontal plane for passage of the ink tubes over the top of the front wall of the unitary guide to the printhead carriage.

30 Claims, 7 Drawing Sheets

74
76
74
76
40
70
78
74
76
42
78
74
76
44
78
74
46
78
72

74
74
82
80
40
41
92
82
42
43
92
82
44
45
72
90
72
92

INK SUPPLY TUBE GUIDING SYSTEM FOR LARGE FORMAT PRINTER

CROSS REFERENCE TO RELATED APPLICATIONS, IF ANY

None.

BACKGROUND OF THE INVENTION AND PRIOR ART

The present invention relates to the art of computer driven printers, particularly, large format color ink jet printers. Printers of this type have a printhead carriage which is mounted for reciprocal movement on the printer in a direction orthogonal to the direction of movement of the paper or other medium on which printing is to take place through the printer. The printer carriage of a color printer typically has four removable piezo-electric or thermal ink jet printheads mounted thereon. Each of the printheads contains a supply of ink which, for large scale printers, is generally inadequate due to the large volumes of ink which are required as compared with the ink supply requirements of desk top printers. Consequently, various means have been proposed for continuously or periodically refilling the carriage-borne printheads with ink. These systems fall into two categories. The first comprises offboard or off-axis ink reservoirs which are continuously connected to the carriage-borne or onboard printheads by flexible tubes. The second comprises a "take a gulp" system in which the printhead carriage is periodically moved to one end of its path of travel where it is then connected with off-axis ink reservoirs to fill the onboard printheads. This "take a gulp" system is disclosed in Hewlett-Packard's Designjet 2000 printer referred to in U.S. patent application Ser. No. 08/805,861 filed Mar. 3, 1997 and published in European Patent Publication No. 0863016 on Sep. 9, 1998.

Large format printers are expensive pieces of equipment which preferably should be capable of using different types of ink without significant down time of the printer when changing or replacing the ink delivery system or components thereof. The different ink types may for convenience be broadly referred to as indoor ink and outdoor ink, meaning ink intend to be used for production of drawings, posters, and other printed material which may be displayed outdoors or indoors. Outdoor ink is pigment based, i.e. containing a plurality of discrete undissolved pigment particles suspended in a fluid carrier. Dye-based ink has a lower degree of optical density and permanence but is less expensive. Since pigment based inks and dye-based inks are incompatible with each other, a system is desired which enables the use of either type of ink in a printer without cross-contamination of the printer inks by each other.

Further, in color printers four or more separate colors of ink may be used comprising black and various primary or mid-primary colors such as cyan, magenta and yellow. In color ink printers provision must also be made to ensure that neither incorrect types of ink nor incorrect colors of ink can inadvertently be used in the system.

Since the ink delivery tubes connected from offboard reservoirs to onboard printheads continually flex, leakage and breakage of the ink supply tubes may be experienced. A reliable ink delivery system and guides for routing the ink delivery tubes to minimize flexing, wear and damage of the ink tubes is desired. One such system is shown in U.S. patent application Ser. No. 08/240,039 filed Jan. 29, 1999 (HP 60980039) by Gasso, et al and owned by the assignee of the present invention, that disclosure being incorporated herein by reference.

SUMMARY OF THE INVENTION

The present invention provides an ink supply tube supporting and guiding system for a large format printer comprising:

a) a unitary tube support and guide having a first tube guide surface, a tube support surface and a second tube guide surface, said first and said second tube guide surfaces extending upwardly from said support surface and being spaced apart to define an ink tube support and guide area therebetween; and b) support structure for supporting said unitary tube guide on a printer.

The present invention further provides an ink delivery system for an inkjet printer which includes a plurality of ink tubes supported in a tube guide and extending from ink supply reservoirs to inkjet printheads on board a moveable printhead carriage, said ink delivery system comprising a carriage connector unit having an in-line tubes driver positioned in and aligned with said tubes in said tube guide, said carriage connector unit including a rigid arm having a plurality of said ink tubes therein arranged in a common plane, said arm extending over the top of an upwardly extending wall of said guide for conveying ink to said printheads.

The present invention further provides an ink delivery tube system for an ink jet printer which includes a plurality of flexible ink delivery tubes for conveying ink from stationary ink reservoirs to inkjet printheads mounted on a moveable carriage, said tube system comprising ink delivery tubes arranged in at least one group extending in an upwardly extending plane, said tubes being bound together along a portion of their length by an anti-buckle tubes carrier, said carrier comprising a protective sheath having integrally formed stretch resistant tension ribs connected to and extending from one side of said carrier a distance sufficient for resisting bending of said carrier and tubes convexly away from said tension ribs, said tension ribs having insignificant compression resistance to permit bending of said carrier and tubes concavely toward said tension ribs.

The present invention further provides, an ink delivery system for an ink jet printer which includes a plurality of ink delivery tubes arranged in spaced generally vertically extending parallel planes, each plane having a number of tubes therein, said tubes in each plan being bound together by separate ink tube carriers, at least one of said carriers having wear resistant surfaces on at least one lateral side which faces away from the other carrier.

The present invention further provides an inkjet printer having a frame, a transversely moveable printhead carriage mounted for reciprocating movement on said frame, ink supply reservoir means mounted on said frame and flexible ink supply tubes for delivering ink from said ink reservoir means to inkjet printheads on said printhead carriage, said printer further comprising a unitary ink tube guiding system comprising:

a) a unitary tube guide having a generally upwardly extending first tube guide surface, a tube support surface and a second generally upwardly extending rear tube guide surface, said generally upwardly extending guide surfaces of said guide being spaced apart to define a tube support and guide area therebetween; and b) support structure for supporting said unified guide on said printer; said flexible ink tubes having substantially parallel first and second reaches and a reverse bend supported on said support surface and confined for sliding movement between said guide surfaces.

DESCRIPTION OF THE PREFERRED EMBODIMENT

Figure 1:
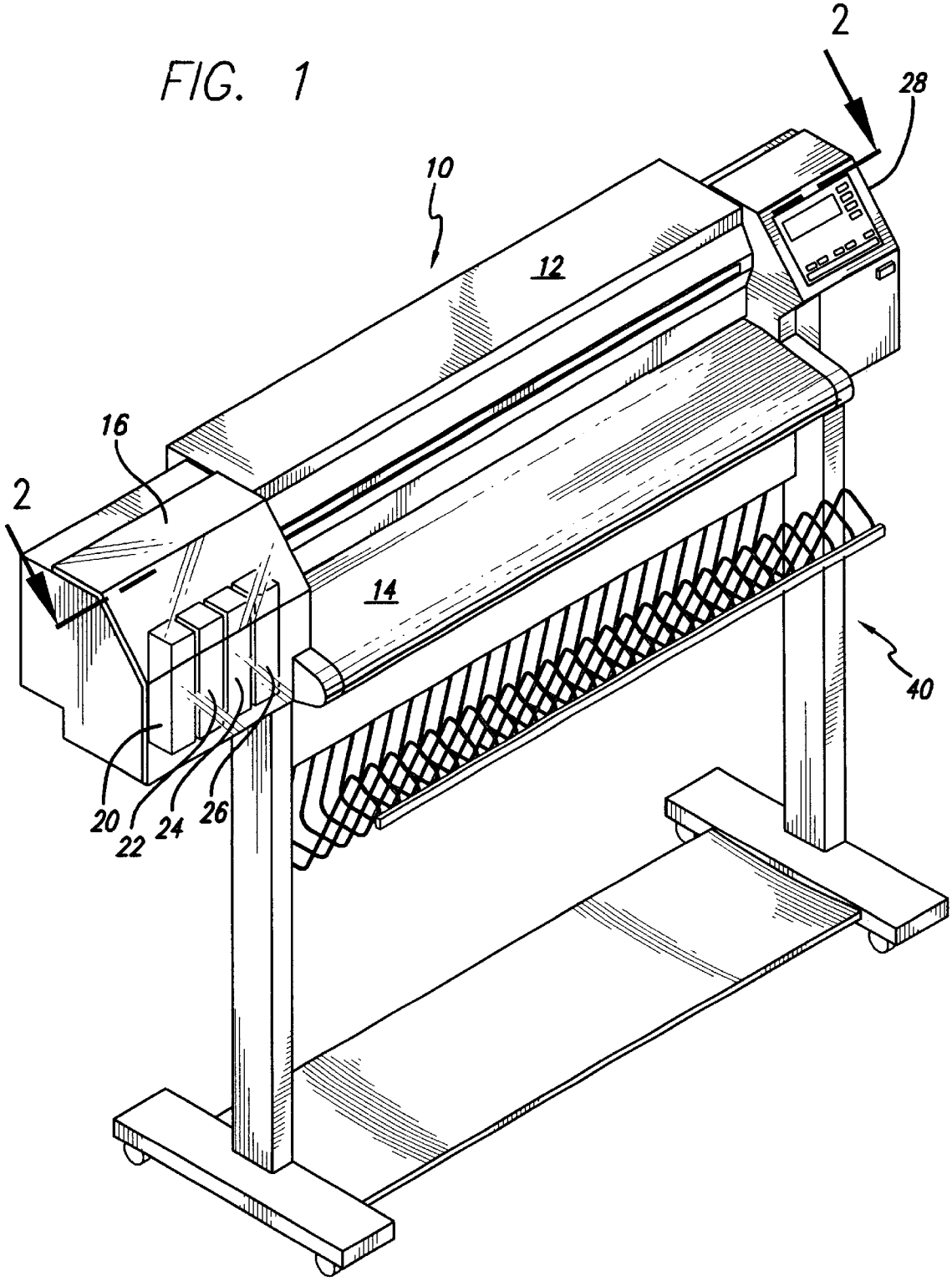
FIG. 1 is a perspective view of a large format printer in which the present invention is useful.

FIG. 1 shows a large format printer 10 of the type which includes a transversely movable printhead carriage 30 (FIG. 2) enclosed by a plastic or metal hinged cover 12 which extends over a generally horizontally extending platen 14 over which printed media is discharged. At the left side of the platen is a hinged cover 16 which contains four or more removable ink reservoirs 20, 22, 24, 26 which, through a flexible tube arrangement 40–46, supply ink to a number of different inkjet printheads mounted on the moveable carriage 30. While each printhead is ordinarily connected to a single ink reservoir, in some instances it may be desirable to include more or less ink reservoirs than printheads so that, for increased ink capacity of, for example black ink, two black ink reservoirs may be connected by two separate black ink tubes to a single black ink printhead or two black ink printheads may be connected to a single black ink reservoir.

Unitary Tubes Guide

Figure 2:
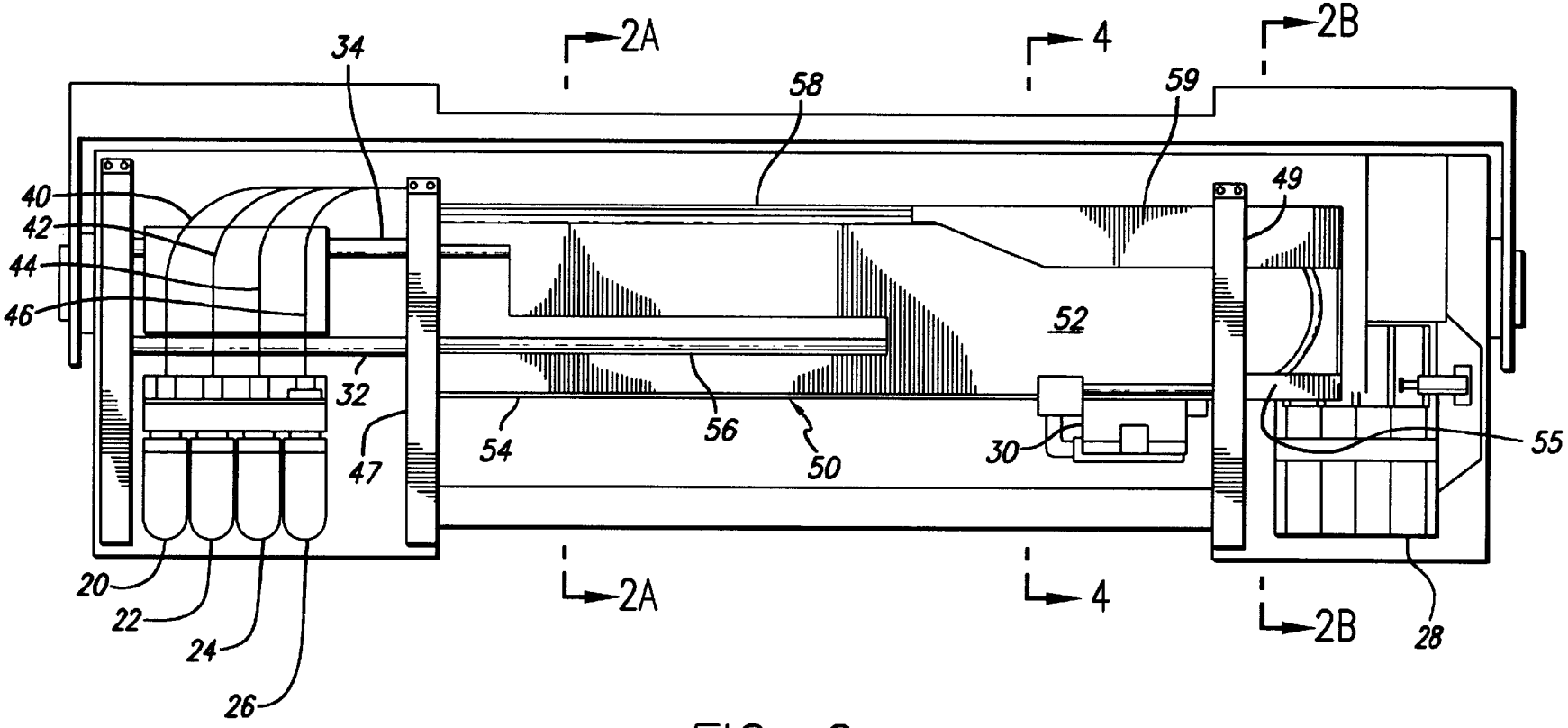
FIG. 2 is a top plan view of the printer with its cover removed to show the printhead carriage and unified ink tube guide and supports, FIGS. 2A and 2B comprising vertical cross sections at the lines indicated.
Figure 2A:
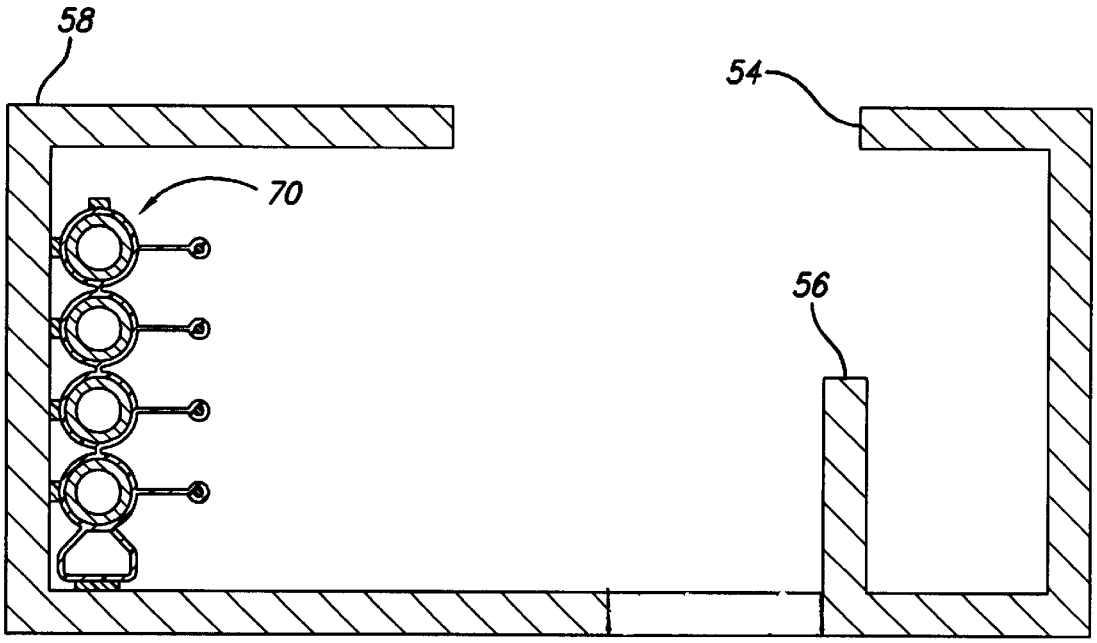
Figure 2B:
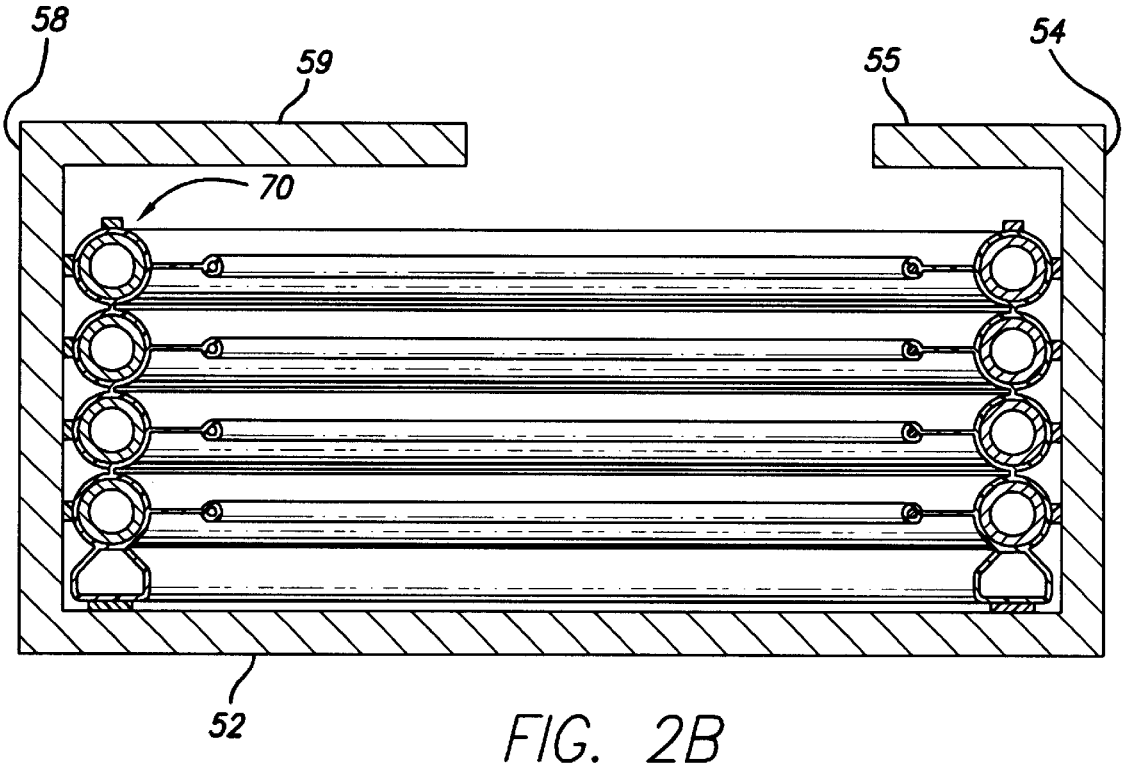
Figure 4:
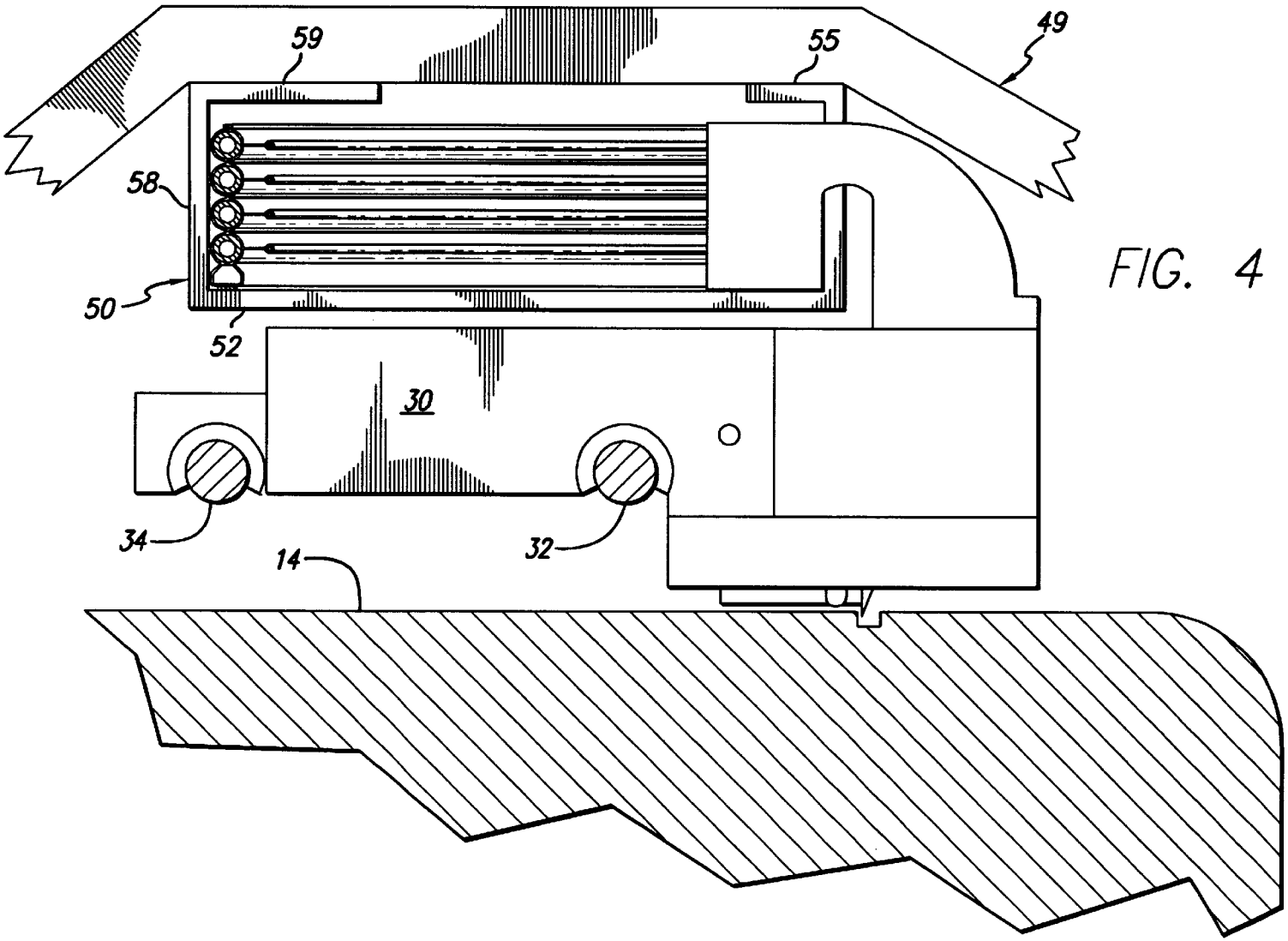
FIG. 4 is a vertical cross-section taken at line 4—4 on FIG. 2 through the relevant portions of the printer showing the relative position of the carriage, the unitary tube guide and an arrangement having four ink delivery tubes.

In the plan view of FIG. 2A in which the carriage cover 12 has been removed and in FIG. 4, it is seen that the printhead carriage 30 is mounted on a pair of transversely extending slider rods or guides 32, 34 which in turn are rigidly affixed to the frame of the printer. Also rigidly affixed to the frame of the printer are two or more tube guide support arches or bridges 47, 49 from which a unitary tube guide 50 is suspended in any suitable manner, for example, by brackets of desired configuration. The presently preferred embodiment of the unitary tube guide 50 essentially comprises a metal or other rigid structure box having a flat horizontally extending bottom wall 52 and generally vertically extending front and rear walls 54, 58 integrally formed therewith from a single piece or fabricated by welding or otherwise interconnecting separate pieces. Preferably the unitary tube guide 50 also has an upper tube confining surface such as generally horizontally extending top flanges connected to the side walls as will be described below. Alternatively, the tube guide 50 may be configured with a generally horizontal bottom and two or more upwardly extending side walls which may be angled toward each other to confine the tubes in the guide instead of the preferred embodiment guide 50 which has vertically extending side walls and horizontal top wall flanges. The unitary guide 50 has superior strength (shock and vibration) characteristics and improved grounding between the parts with no need for extra grounding straps. In addition, the presence of guide 50 prevents dirt and debris such as dust generated due to normal use of the tube carrier rubbing in the tube guides from falling onto the platen 14 or into a printhead service station 100 typically provided at the right end of the path of carriage travel.

A vertically extending anti-buckling wall 56 is preferably formed parallel to the front wall 54 by upwardly bending a cutout section of the bottom wall 52. The anti-buckling wall 56 is considered necessary for 60" width printers and above. Near one end of the unified tubes guide 50, spaced horizontally extending top flanges 55, 59 are provided as continuations of the vertically extending front and rear walls 54, 58, respectively. It will be appreciated that there is no relative motion between the rear wall 58 of the tube guide and the tubes in the section which is uncovered by the top flange.

Although not shown in the drawings which depict a unitary guide 50 having a straight front wall 54, persons skilled in the art will recognize that the front wall 54 may be angled (in plan view) toward the back of the printer near its left end near the left bridge support 47 as shown in the above mentioned application Ser. No. 08/240,039 to provide a clearance area for opening a printhead holddown cover 36 on the carriage 30 when the carriage is slid to a position proximate the left side of the platen 14 so that the printhead holddown cover can be easily opened for changing the printheads.

A flexible ink delivery tube system conveys ink from the various separate ink reservoirs 20, 22, 24, 26 at the left side of the printer through four or more flexible ink tubes 40, 42, 44, 46 which extend from the ink reservoirs through the unitary tube guide 50 to the carriage 30 to convey ink to four (or more) printheads on the carriage 30. The entire ink tube delivery system may be a replaceable system as described and claimed in the aforementioned co-pending application Ser. No. 09/240,039 filed Jan. 29, 1999 by Gasso, et al (HP 60980039). It has been found that routing of the ink delivery tubes over the front wall 54 of the unified tubes carrier 50 facilitates replacement of the ink delivery system when necessary as compared with the structure shown in Ser. No. 09/240,039.

At the right side of the printer is a printhead service station 80 at which the printhead carriage 30 may be parked for servicing such as wiping, spitting or priming the printheads. Each of the various ink reservoirs 20, 22, 24, 26 is easily accessible from the front of the printer when the reservoir cover 16 (seen in FIG. 1) is open so that the reservoirs can be easily removed to be refilled or replaced with new reservoirs. As is known in the art, the reservoirs each contain a different base color of ink such as cyan, magenta and yellow or blab so that a high number of colors can be produced as desired during printing.

As best seen in FIGS. 2 and 4, the bottom wall 52 of the guide 50 provides a support surface which extends in a horizontal plane for supporting substantially the entire moving length including the reverse bend of the ink delivery tubes 40, 42, 44, 46. The ink tubes are preferably bound together in a flexible wear resistant low friction anti-buckle tube carrier 70 to confine the tubes in a vertical plane and prevent wear as the tubes move in the guide 50.

Anti-Buckle Tubes Carrier

Compression buckling of the ink delivery tubes is known to occur in large printers due to the extreme generally unconfined (except by the unitary tubes guide 50) length of tubes which are repeatedly pulled and pushed by the printhead carriage 30. The tubes tend to buckle toward the back of the tubes guide 50. Elimination of the tube buckling problem, which at minimum results in deterioration of print quality and at maximum complete shutdown of printing, is achieved in part by the unitary tube guide described above and further by a unique anti-buckle tube carrier 70 to be described.

Figure 5:
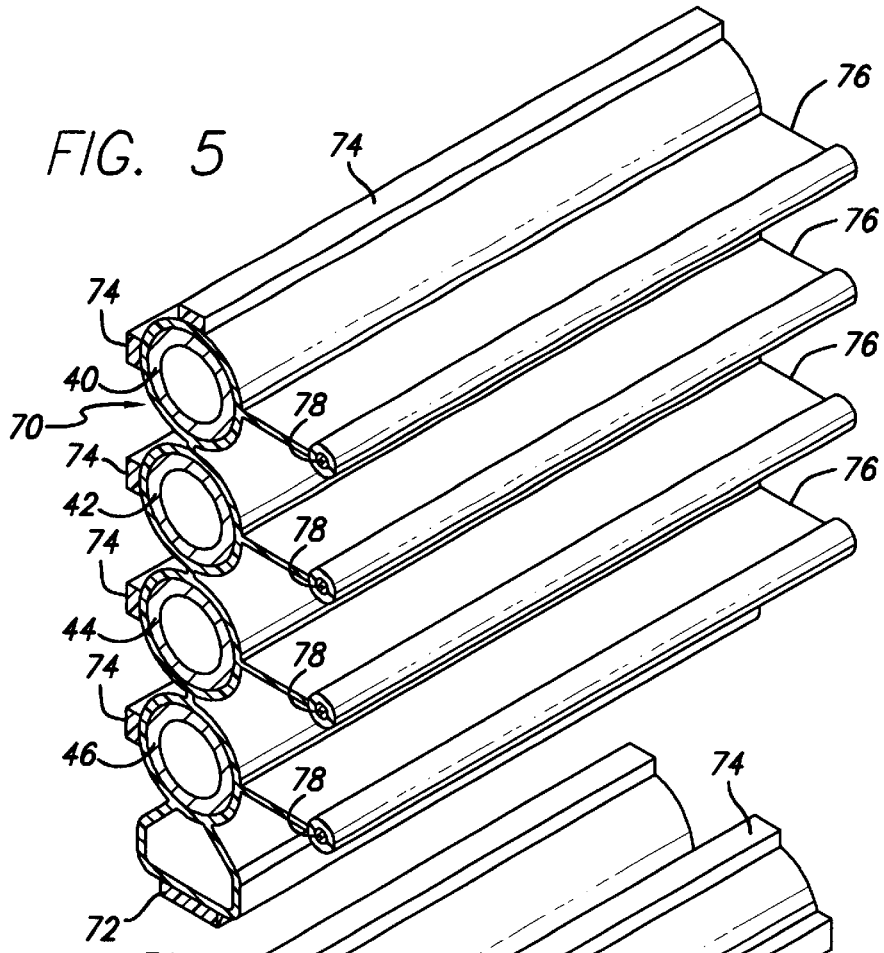
FIG. 5 is a perspective of an anti-buckle tube carrier.

The flexible ink delivery tubes 40, 42, 44, 46 are confined in the anti-buckle tube carrier 70 which is preferably permanently connected at the ink delivery end of the tubes to a printhead connector 100 which is a relatively rigid plastic part best seen in FIGS. 4 and 7–10. The ink delivery tubes are preferably made of a linear low density polyethylene. The anti-buckle tube carrier 70 comprises a protective polypropylene sheath which encloses the flexible ink tubes at least along that portion of their length which is subject to buckling flex and includes an integrally molded wear resistant shoe 72 on the lowermost surface which is slidably supported on the bottom wall 52 of the unitary tube guide 50. As shown in FIG. 5, four ink tubes are arranged in parallel in one common plane. Other arrangements are of course possible and although the drawings depict use of the anti-buckle tube carrier 70 in a unitary tube guide 50 as described above, persons skilled in the art will recognize that the anti-buckle tubes carrier 70 described herein can also be used in other configurations of tube guides such, for example, as the one shown in the aforementioned U.S. patent application Ser. No. 09/240,039. The anti-buckle tube carrier 70 also includes wear resistant lubricous ribs 74 on the top of the upper tube 40 and on the sides of all of the tubes 40, 42, 44, 46 which face the front guide wall 54. The ribs 74 are preferably made from polypropylene containing about 5% aramid fibers and 20% polytetrafluoroethylene (TEFLON). The material of the anti-buckle carrier 70 is preferably a polypropylene and EPDM compound which is both flexible and fatigue resistant. The above combination of materials for the carrier and ribs has been found to be considerably more quiet than prior art flexible ink delivery systems. Buckling is prevented by forming anti-buckling tension ribs 76 on the sides of the carrier opposite the lubricous ribs 74. The tension ribs 76 are much longer than the wear resistant ribs 74 and may be co-extruded with a glass fiber cable 78 in each rib 76 if desired.

Forces imparted to the ink tubes as the carriage moves to the right from the left end of its path of travel place the ink tubes in compression which tends to induce buckling of the tubes toward the anti-buckling wall 56 of the tube guide 50. Buckling of the ink tubes is resisted by increasing tension in the ribs 76 and cables 78 (if provided) as bending begins to take place. Conversely, when the tubes are bent in the reverse direction at the right end of the printer, the tension ribs 76 are placed in compression and tend to collapse since the ribs are not designed to resist compression so as to permit the necessary flexing of the tubes 40, 42, 44, 46 in their reverse bend.

Parallel Plane Multiple Ink Tube Carriers

Figure 6:
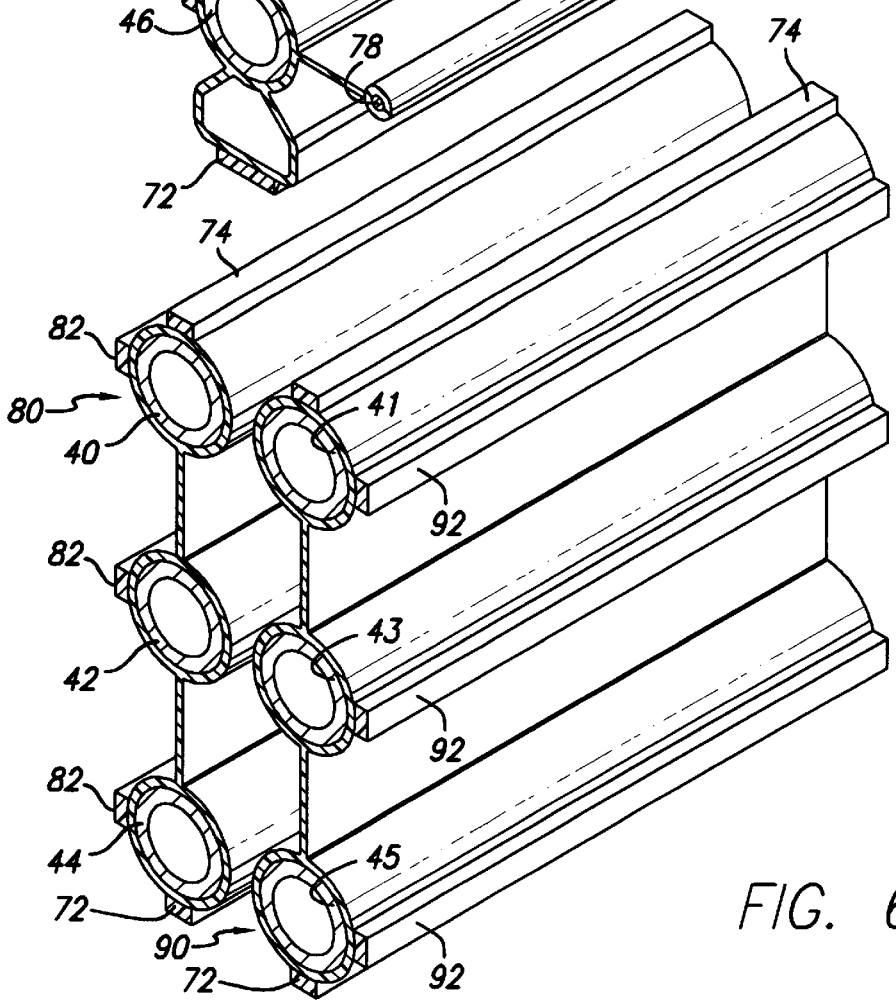
FIG. 6 is a perspective view of parallel multiple tube carriers.
Figure 7:
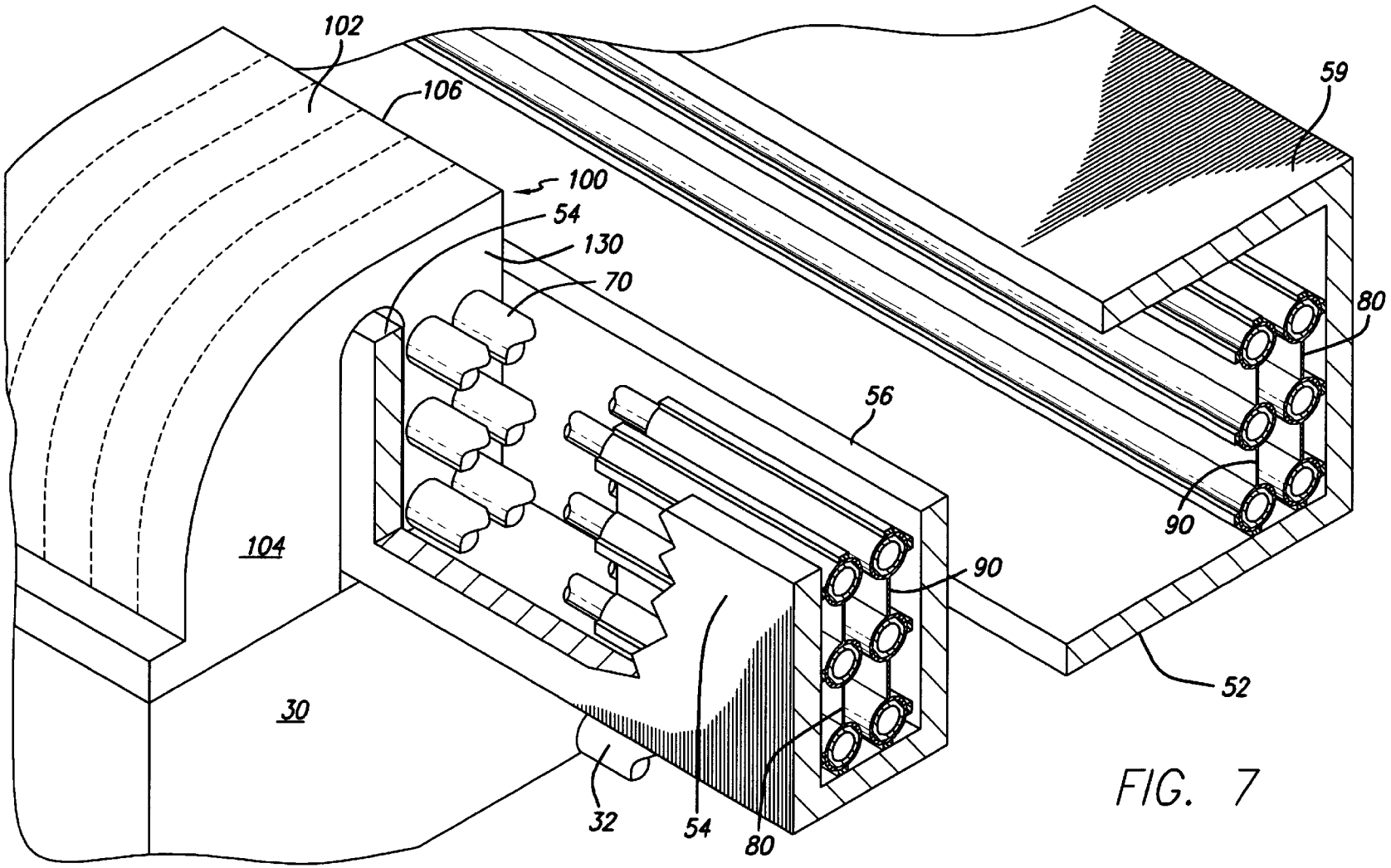
FIG. 7 is a perspective view of a tubes guide containing multiple tube carriers each having three tubes and an in-line tubes driver.

It is advantageous, particularly in the design of printers which have more than four separate ink reservoirs, ink delivery systems and printheads, to arrange the ink delivery system tubes other than in a single plane. FIG. 6 is a perspective view of a parallel carrier ink delivery system using multiple tube carriers 80, 90 each carrying three tubes 40, 42, 44; 41, 43, 45 arranged in a plane, the tubes in the two separate carriers being arranged in essentially parallel vertically extending planes which are spaced from each other to avoid rubbing in the reverse bend area of the ink delivery tubes. Although the carriers 80, 90 are not connected together and are permitted to separate along their lengths for flexibility, they are joined at the ink delivery ends to a printhead carriage connector unit 100. The outer carrier 80 also has lubricous ribs 82 at least on the sides of preferably all of the tubes which face the front guide wall 54. A wear shoe 72 and upper wear rib 74 like those shown in the four tube arrangement of FIG. 5 may also be provided. The inner carrier 90 preferably has lubricous ribs 92 on the sides of the tubes which face away from the carrier 80 which may contact the anti-buckling wall 56. The ribs 82, 92 may, like the ribs 74 described above, be made from polypropylene containing about 5% aramid fibers and 20% polytetafluoroethylene (TEFLON). The material of the carriers or sheaths 80, 90 may be a polypropylene and EPDM compound which is both flexible and fatigue resistant. The anti-buckle tubes carrier 70 described above may be used as the inner carrier 90 as an alternative to the arrangement shown in FIG. 6. Also, like the anti-buckle tubes carrier 70 described above, parallel plane multiple tubes carriers 80, 90 can be used in tube guides of other configurations than the unitary tubes guide 50 described and shown herein.

Carriage Connector Unit with in Line Tubes Driver

Control of the ink delivery system tubes is further improved by provision of a carriage connector unit 100 (FIG. 7) which comprises one or more relatively rigid plastic parts which route the relatively flexible ink tubes from the tube guide 50 to the printhead carriage 30. The specific construction of the carriage connection end of the unit 100 is not part of the present invention but may take the form shown in the above mentioned co-pending application Ser. No. 08/240,039. A rigid arch or crane 102 extends over the top of the front wall 54 of the unitary tube guide 50 and interconnects the carriage connection 104 with a rigid block 106 having internal conduits (unnumbered) which each receive an ink tube extending therethrough. The conduits terminate at an in line tubes driver 130 having a generally flat end wall which is positioned in and aligned with the unitary tubes guide 50 between the front wall 54 and, if provided, the anti-buckle wall 56, such that the flat end wall is perpendicular to the length of the ink tubes which are passed through the conduits. The tubes carrier or carriers 80, 90 are preferably permanently connected to the flat end wall of the in line tubes driver 130 in any suitable manner, for example by cementing.

Figure 3:
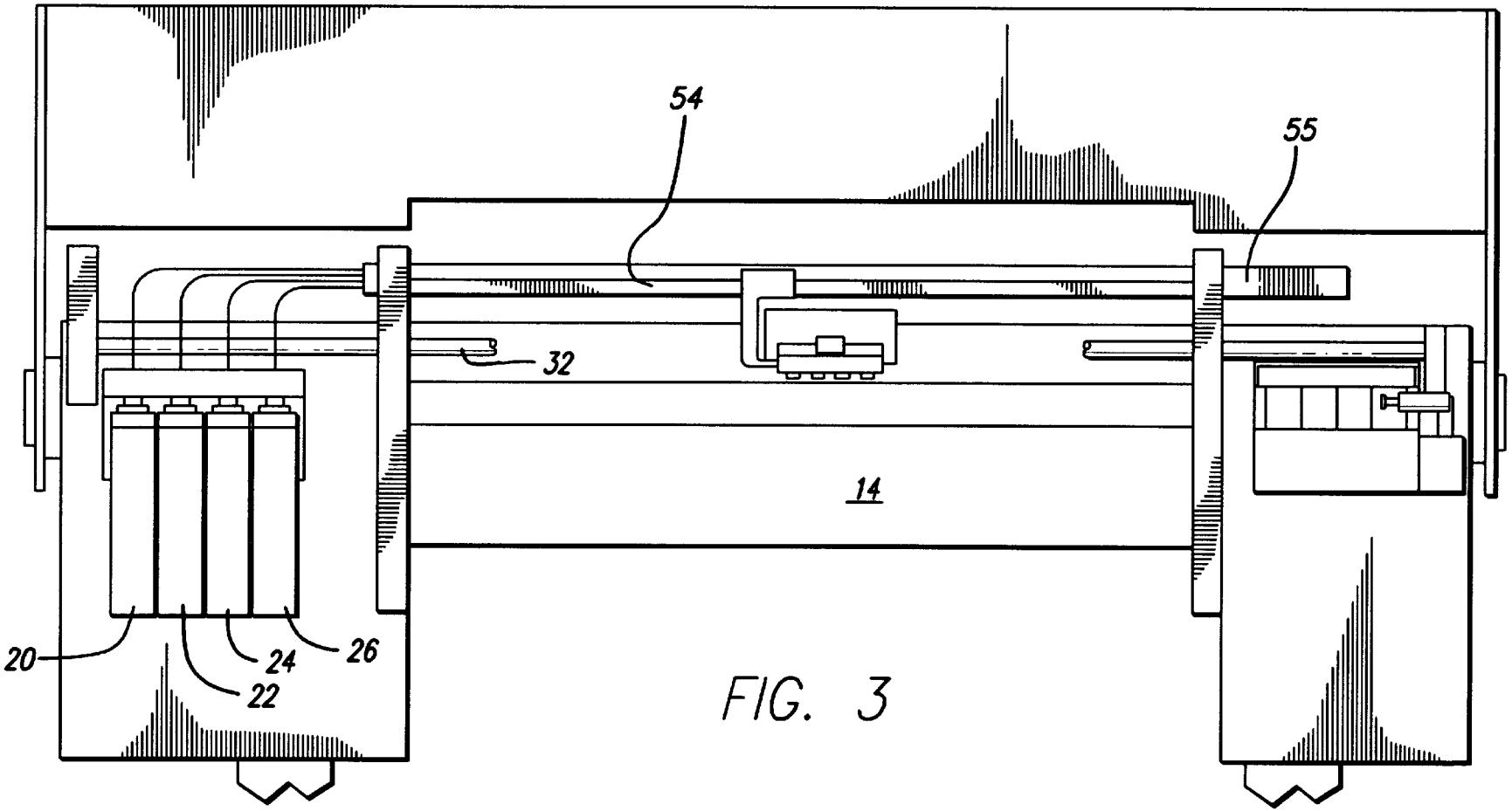
FIG. 3 is a front elevation view of the upper portion of the printer with cover removed to show the printhead carriage and attached printhead connector tubes.

The ink tubes extend through the conduits 110–120 in the carriage connector unit 100 and through the crane 102 to the carriage connection 104 for ink delivery to the printheads as is known in the art. The ink tubes are preferably arranged in side by side rows of three at the flat end wall of the in-line tubes driver 130; however, the tubes are routed in the connector unit 100 such that all six tubes are arranged in a common plane as they pass through the crane 102 so that the vertical dimension of the crane may be kept to a minimum where it passes over the front wall 54 of the unitary tubes guide 50. Although the drawings show the crane extending over the front wall of a tubes guide of the type shown in FIGS. 2–4, persons skilled in the art will understand that the carriage connector unit 100 may be configured to be used with other tube guide configurations, such, for example, as a tubes guide having a full height front wall and a shorter rear or anti-tube buckling wall. In such an arrangement the crane is configured to extend over the top of the anti-buckling wall to the rear for attachment of the carriage connection 104 to the printhead carriage 30. It will also be understood that use of a carriage connector unit 100 as shown and described herein which routs the tubes over the front wall 54 permits the use of a higher anti-buckling wall 56 than would be possible if the tubes were routed rearwardly over the top of the anti-buckling wall.

Although the presently preferred embodiments of the invention have been shown and described in detail, those skilled in the art will appreciate that various modifications may be made without departing from the spirit and scope of the invention which is defined in the appended claims.

What is claimed is:

1. An ink supply tube supporting and guiding system for a large format printer comprising:

a) a unitary tube support and guide having a first tube guide surface, a tube support surface and a second tube guide surface, said first and said second tube guide surfaces being spaced apart to define an ink tube support and a tube guide area therebetween; and b) an anti-buckling wall to confine movement of a portion of the ink delivery tubes to the guide area between said first tube guide surface and said anti-buckling wall.

2. The guiding system of claim 1, wherein said first tube guide surface and said second tube guide surface of said unitary tube support and guide extend in spaced generally vertical planes and said tube support surface is generally horizontal, and said unitary tube support and guide further comprises generally horizontally extending upper tube guide surfaces extending toward each other from said generally vertically extending guide surfaces above said tube guide area.

3. The guiding system of claim 1, wherein said support structure comprises spaced bridge supports, said unitary tube support and guide being suspended by connection of said upper tube guide support surfaces to said bridge supports on a printer above the path of movement of a printhead carriage.

4. An ink delivery system for an inkjet printer, said system comprising a tube guide and a plurality of ink tubes supported in said tube guide and extending from ink supply reservoirs to inkjet printheads on board a moveable printhead carriage, said ink delivery system further comprising a carriage connector unit having an in-line tubes driver positioned in and aligned with said tubes in said tube guide, said carriage connector unit including a rigid arm having a plurality of said ink tubes therein arranged in a common plane, said arm extending over the top of an upwardly extending wall of said tube guide for conveying ink to said printheads.

5. The ink delivery system of claim 4, wherein said ink tubes pass through said in-line driver in an arrangement having parallel upwardly extending rows of said ink tubes.

6. The ink delivery system of claim 4, wherein said carriage connector unit guides said tubes without kinking from a first position in said tubes guide from a direction extending generally parallel to a path of movement of said printhead carriage upwardly and transversely over said upwardly extending wall of said tube guide and said tubes terminate in a generally downwardly extending direction for connection to said printheads.

7. An ink delivery tube system for an ink jet printer which includes a plurality of flexible ink delivery tubes for conveying ink from stationary ink reservoirs to inkjet printheads mounted on a moveable carriage, said tube system comprising at least some of said plurality of said ink delivery tubes arranged in at least one group extending in an upwardly extending plane, said tubes being bound together along a portion of their length by an anti-buckle tubes carrier, said carrier comprising a protective sheath having integrally formed stretch resistant tension ribs connected to and extending from one side of said carrier a distance sufficient for resisting bending of said carrier and tubes convexly away from said tension ribs, said tension ribs having insignificant compression resistance to permit bending of said carrier and tubes concavely toward said tension ribs.

8. The ink delivery tube system of claim 7, wherein one of said tension ribs is provided for each ink tube in said carrier.

9. The ink delivery tube system of claim 7, further comprising tension reinforcing cables in said tension ribs.

10. The ink delivery tube system of claim 7, further comprising wear resistant shoes on lower and upper surfaces of said carrier for slidably contacting a tube guide.

11. The ink delivery tube system of claim 7, further comprising wear resistant ribs on the side of said carrier opposite said tension ribs.

12. An ink delivery system for an inkjet printer, said delivery system including a plurality of ink delivery tubes arranged in generally parallel planes, each plane having a number of tubes therein, said tubes in each plane being bound together by separate ink tube carriers, at least one of said carriers having wear resistant surfaces on at least one lateral side which faces away from an other one of said carriers.

13. The ink delivery system of claim 12, further comprising wear resistant surfaces on each of said carriers, said wear resistant surfaces being on the lateral sides of said carriers which face away from the other carrier.

14. The ink delivery system of claim 13, wherein said carriers have none of said wear resistant surfaces on the sides of said carriers which face each other.

15. The ink delivery system of claim 14, further comprising wear resistant shoes on said carriers for engaging ink delivery tube support and guide structure on a printer.

16. An inkjet printer having a frame, a transversely moveable printhead carriage mounted for reciprocating movement on said frame, ink supply reservoir means mounted on said frame and flexible ink supply tubes for delivering ink from said ink supply reservoir means to inkjet printheads on said printhead carriage, said printer further comprising a unitary ink tube guiding system comprising:

a) a unitary tube guide having a first tube guide surface, a tube support surface and a second tube guide surface, said guide surfaces of said unitary tube guide being spaced apart to define a tube support and a tube guide area therebetween; and b) support structure for supporting said unitary tube guide on said printer; said flexible ink tubes having substantially parallel first and second reaches and a reverse bend supported on said support surface and confined for sliding movement between said guide surfaces.

17. The printer of claim 16, wherein said tubes extend in parallel to each other, and further comprising a protective sheath containing said tubes along at least a portion of a length from said second guide surface through said reverse bend to said printhead connector.

18. The printer of claim 16, further comprising wear resistant ribs on areas of said sheath which contact said unitary tube guide.

19. The printer of claim 16, further comprising a carriage connector unit having an in-line tubes driver positioned in and aligned with said tubes in said unitary tube guide, said carriage connector unit including a rigid arm having a plurality of said ink tubes therein arranged in a common plane, said arm extending over the top of one of said upwardly extending guide surfaces of said guide for conveying ink to said printheads.

20. The printer of claim 19, wherein said ink tubes pass through said in-line driver in an arrangement having parallel upwardly extending rows of said ink tubes.

21. The printer of claim 20, wherein said carriage connector unit guides said tubes without kinking from a first position in said tubes guide from a direction extending generally parallel to said reciprocating movement of said printhead carriage upwardly and transversely over said first guide surface of said guide and said tubes terminate in a generally downwardly extending direction for connection to said printheads.

22. The printer of claim 16, wherein said ink supply tubes are arranged in at least one group extending in an upwardly extending plane, and further comprising an anti-buckle tubes carrier binding said tubes together along at least a portion of their length, said carrier comprising a protective sheath having integrally formed stretch resistant tension ribs connected to and extending from one side of said carrier a distance sufficient for resisting bending of said carrier and tubes convexly toward said tension ribs, said tension ribs having insignificant compression resistance to permit bending of said carrier and tubes concavely toward said tension ribs.

23. The printer of claim 22, wherein one of said tension ribs is provided for each ink tube in said carrier.

24. The printer of claim 22, further comprising tension reinforcing cables in said tension ribs.

25. The printer of claim 22, further comprising wear resistant shoes on lower and upper surfaces of said carrier for slidably contacting a tube guide.

26. The printer of claim 25, further comprising wear resistant ribs on the side of said carrier opposite said tension ribs.

27. The printer of claim 16, wherein said ink supply tubes are arranged in spaced generally upwardly extending parallel planes, each plane having a number of said tubes therein, said tubes in each plane being bound together by separate ink tube carriers, at least one of said carriers having wear resistant surfaces on at least one lateral side which faces away from the other carrier.

28. The printer of claim 27, further comprising wear resistant surfaces on each of said carriers, said wear resistant surfaces being on the lateral sides of said carriers which face away from the other carrier.

29. The printer of claim 28, wherein said carriers have none of said wear resistant surfaces on the sides of said carriers which face each other.

30. The printer of claim 29, further comprising wear resistant shoes on the lower surfaces of said carriers for engaging said tube support surface.

* * * * *